US010723005B2

(12) United States Patent
Meyer et al.

(10) Patent No.: US 10,723,005 B2
(45) Date of Patent: Jul. 28, 2020

(54) ELECTRIC FASTENER DRIVING TOOL ASSEMBLY INCLUDING A DRIVER HOME POSITION SENSOR

(71) Applicant: Black & Decker Inc., New Britain, CT (US)

(72) Inventors: Jeffrey J. Meyer, Baltimore, MD (US); Dylan Parker, Towson, MD (US); Alastair Valentine, Baltimore, MD (US)

(73) Assignee: Black & Decker Inc., New Britain, CT (US)

( * ) Notice: Subject to any disclaimer, the term of this patent is extended or adjusted under 35 U.S.C. 154(b) by 315 days.

(21) Appl. No.: 15/938,727

(22) Filed: Mar. 28, 2018

(65) Prior Publication Data

US 2019/0299380 A1 Oct. 3, 2019

(51) Int. Cl.

| | |
|---|---|
| ***B25C 1/06*** | (2006.01) |
| ***B25C 1/00*** | (2006.01) |
| *B25C 5/15* | (2006.01) |

(52) U.S. Cl.

CPC ..... *B25C 1/008* (2013.01); *B25C 1/06* (2013.01); *B25C 5/15* (2013.01)

(58) Field of Classification Search

CPC .. B25C 1/008; B25C 1/06; B25C 1/08; B25C 1/04; B25C 1/047; B25C 5/15; B25F 5/001; B25F 5/02; B25D 11/064

USPC ..... 227/2, 8, 130, 131, 132, 136; 173/2, 173/117, 217

See application file for complete search history.

(56) References Cited

U.S. PATENT DOCUMENTS

| | | | | |
|---|---|---|---|---|
| 4,395,711 | A | 7/1983 | Ward | |
| 4,553,074 | A | 11/1985 | Jacquemet | |
| 4,699,223 | A | 10/1987 | Noren | |
| 4,799,557 | A | 1/1989 | Jacquemet | |
| 4,955,119 | A * | 9/1990 | Bonomi | B21J 15/10 227/58 |
| 5,893,203 | A * | 4/1999 | Buttrick, Jr. | B21J 15/022 227/4 |
| 6,112,939 | A * | 9/2000 | Yoshie | B27F 7/38 221/197 |
| 6,484,814 | B2 | 11/2002 | Bongers-Ambrosius | |
| 6,783,045 | B2 | 8/2004 | Shima et al. | |
| 6,971,567 | B1 * | 12/2005 | Cannaliato | B25C 1/06 173/1 |
| 6,983,871 | B2 | 1/2006 | Shima et al. | |
| 7,059,506 | B2 | 6/2006 | Mochizuki et al. | |

(Continued)

FOREIGN PATENT DOCUMENTS

WO WO 2018/119074 A1 6/2018

OTHER PUBLICATIONS

Extended European Search Report dated Aug. 29, 2019 in European Patent Application No. 19165434.2.

*Primary Examiner* — Scott A Smith

(74) *Attorney, Agent, or Firm* — Harness, Dickey & Pierce, P.L.C.

(57) ABSTRACT

An electric fastener driving tool assembly can include a driver designed to drive a fastener into a workpiece. The driver can reciprocate along an axial driver path between an extended position and a home position. A home position sensor can be located laterally adjacent the axial driver path. The home position sensor can be located to sense the presence of the driver in the home position when a lateral distance between the driver and the sensor changes.

20 Claims, 17 Drawing Sheets

(56) References Cited

U.S. PATENT DOCUMENTS

| | | | | |
|---|---|---|---|---|
| 7,108,164 | B2 | 9/2006 | Shima et al. | |
| 7,357,013 | B2 | 4/2008 | Frohlich | |
| 7,427,007 | B2 | 9/2008 | Shima et al. | |
| 7,494,036 | B2 * | 2/2009 | Shima | B25C 1/06 227/131 |
| 7,494,037 | B2 | 2/2009 | Simonelli et al. | |
| 7,503,400 | B2 | 3/2009 | Llewellyn | |
| 7,537,145 | B2 | 5/2009 | Gross et al. | |
| 7,665,540 | B2 | 2/2010 | Gross et al. | |
| 7,793,811 | B1 | 9/2010 | Pedicini et al. | |
| 7,913,890 | B2 | 3/2011 | Gross et al. | |
| 7,934,566 | B2 | 5/2011 | Hlinka et al. | |
| 7,938,305 | B2 | 5/2011 | Simonelli et al. | |
| 8,011,551 | B2 | 9/2011 | Marczyk et al. | |
| 8,079,504 | B1 | 12/2011 | Pedicini et al. | |
| 8,162,073 | B2 | 4/2012 | Krondorfer et al. | |
| 8,225,978 | B2 | 7/2012 | Gross et al. | |
| 8,276,798 | B2 | 10/2012 | Moeller et al. | |
| 8,302,832 | B2 | 11/2012 | Porth et al. | |
| 8,353,435 | B2 | 1/2013 | Gross et al. | |
| 8,363,185 | B2 | 1/2013 | Cho et al. | |
| 8,505,798 | B2 | 8/2013 | Simonelli et al. | |
| 8,523,035 | B2 | 9/2013 | Pedicini et al. | |
| 8,556,152 | B2 | 10/2013 | Marczyk et al. | |
| 8,713,980 | B2 | 5/2014 | Fleischer et al. | |
| 8,800,834 | B2 | 8/2014 | Pedicini et al. | |
| 8,869,578 | B2 | 10/2014 | Fleischer et al. | |
| 8,925,780 | B2 | 1/2015 | Largo et al. | |
| 9,016,395 | B2 | 4/2015 | Scott | |
| 9,079,237 | B2 | 7/2015 | Fleischer et al. | |
| 9,415,488 | B2 * | 8/2016 | Puzio | B25F 5/02 |
| 9,782,881 | B2 * | 10/2017 | Wolf | B25C 1/08 |
| 9,962,821 | B2 * | 5/2018 | Pedicini | B25C 1/06 |
| 2004/0232194 | A1 | 11/2004 | Pedicini et al. | |
| 2005/0242154 | A1 * | 11/2005 | Leimbach | B25C 1/06 227/131 |
| 2006/0180631 | A1 | 8/2006 | Pedicini et al. | |
| 2007/0102471 | A1 * | 5/2007 | Gross | B25C 1/008 227/131 |
| 2013/0320068 | A1 * | 12/2013 | Gregory | B25C 1/00 227/139 |
| 2014/0001224 | A1 | 1/2014 | McNeill et al. | |
| 2015/0052730 | A1 | 2/2015 | Dickerson | |
| 2015/0174744 | A1 | 6/2015 | Scott et al. | |
| 2016/0374668 | A1 | 12/2016 | Measamer et al. | |
| 2017/0001291 | A1 | 1/2017 | Schnell et al. | |
| 2017/0066116 | A1 | 3/2017 | Garber et al. | |
| 2018/0001455 | A1 | 1/2018 | Meyer et al. | |
| 2018/0001456 | A1 | 1/2018 | Garber | |

* cited by examiner

ELECTRIC FASTENER DRIVING TOOL ASSEMBLY INCLUDING A DRIVER HOME POSITION SENSOR

FIELD

The present disclosure relates to electric fastener driving tools, for driving nails or staples, in which the driver reciprocates axially from a home position.

BACKGROUND

This section provides background information related to the present disclosure which is not necessarily prior art.

Fastener driving tools for driving nails or staples typically include an axially reciprocating driver to drive the fastener into a workpiece. The driver can reciprocate between a home position, and an extended position. It is important that the driver be returned completely to the home position after firing. If the tool is again fired before the driver is returned to its home position, the driver can be driven with insufficient force, which can lead to jams or other problems.

One way to insure the driver returns to its home position is to provide a driver return motor or mechanism. Such a driver return mechanism can be designed to operate longer than necessary in order to insure the return mechanism actually fully returns the driver to its home position each time. This can result in excessive heat and wear of the driver return mechanism; particularly when the tool is fired rapidly in succession.

SUMMARY

This section provides a general summary of the disclosure, and is not a comprehensive disclosure of its full scope or all of its features.

In accordance with one aspect of the present disclosure, an electric fastener driving tool assembly can include a driver designed to drive a fastener into a workpiece. The driver can reciprocate along an axial driver path between an extended position and a home position. A home position sensor can be located laterally adjacent the axial driver path. The home position sensor can be located to sense the presence of the driver in the home position when a lateral distance between the driver and the sensor changes.

In accordance with another aspect of the present disclosure, cordless electric fastener driving tool assembly can include a driver designed to drive a fastener into a workpiece. The driver can reciprocate along an axial driver path between an extended position and a home position. In addition, the driver can include a laterally extending driver guide ear that comprised a target portion of the driver. A home position sensor can be located laterally adjacent the axial driver path. The home position sensor can be located to sense the presence of the driver in the home position when the target portion of the driver guide ear comes closer to the home position sensor as the driver guide ear moves into a position laterally adjacent to the sensor to cause the lateral distance between the driver and the sensor to decrease.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings and throughout the several embodiments.

DETAILED DESCRIPTION

Figure 1:
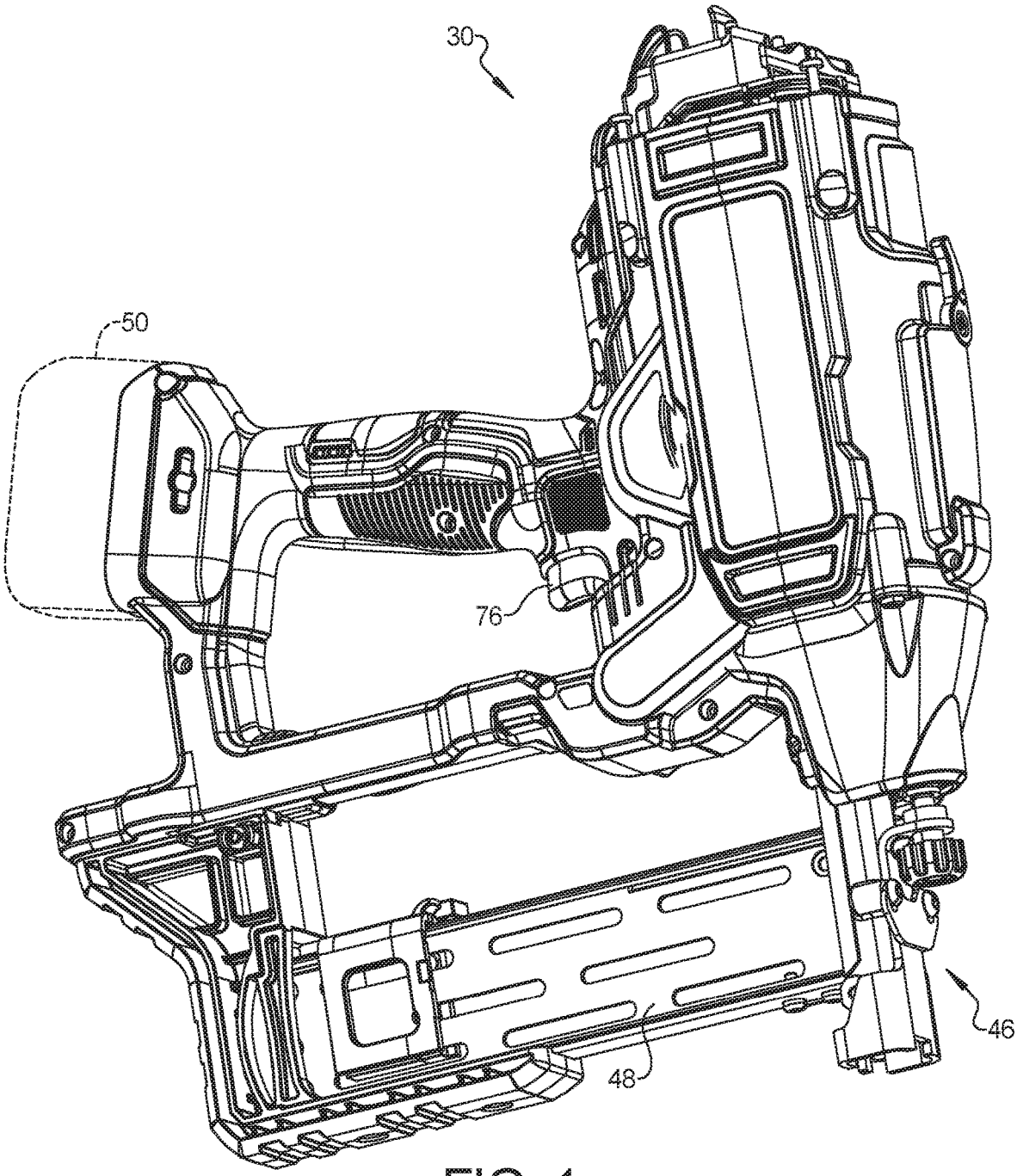
FIG. 1 is a perspective view of one example of a cordless electric fastener driving tool including a first example of an assembly including a home position sensor in accordance with the present disclosure.
Figure 2:
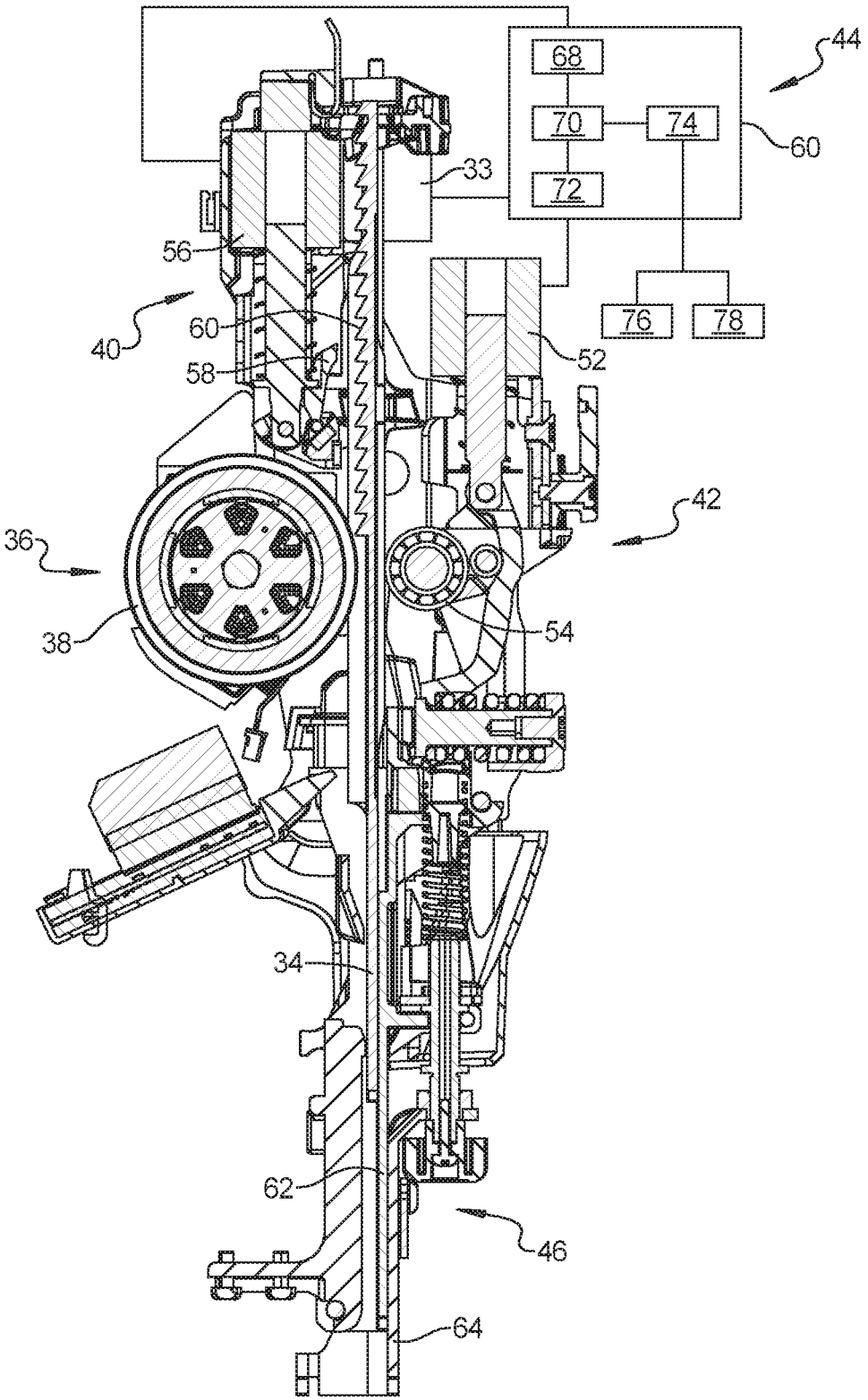
FIG. 2 is a cross-section view of various components of the cordless electric fastener driving tool and of the example assembly of FIG. 1.
Figure 3:
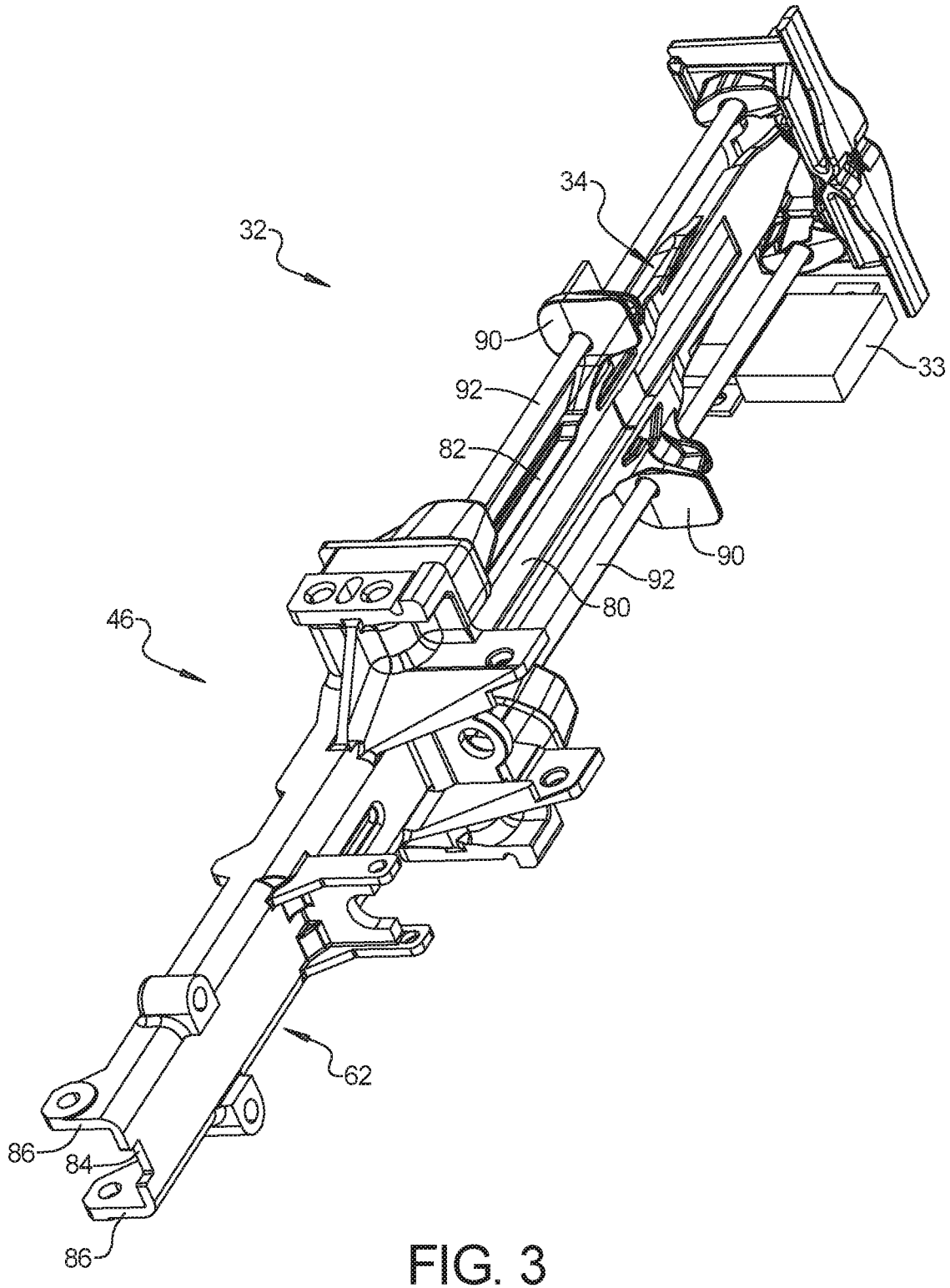
FIG. 3 is a perspective view including various components of the example electric fastener driving tool assembly of FIG. 1.
Figure 4:
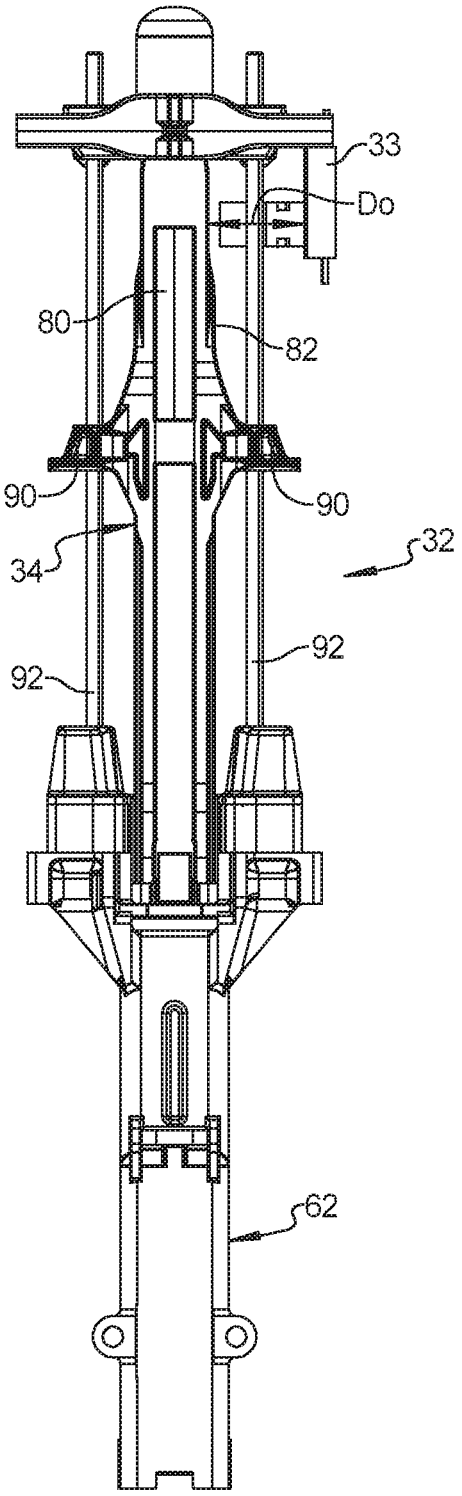
FIG. 4 is a major side elevation view including various components of the example electric fastener driving tool assembly of FIG. 1 with the driver in a non-home position between the home and extended positions.
Figure 5:
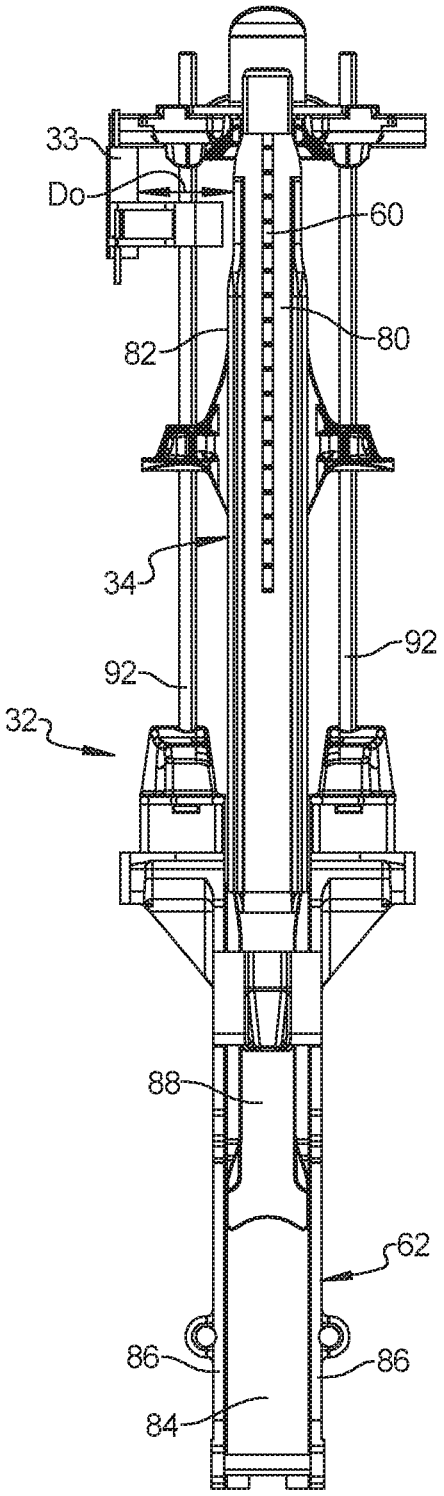
FIG. 5 is an opposite major side elevation of the components of FIG. 4.
Figure 6:
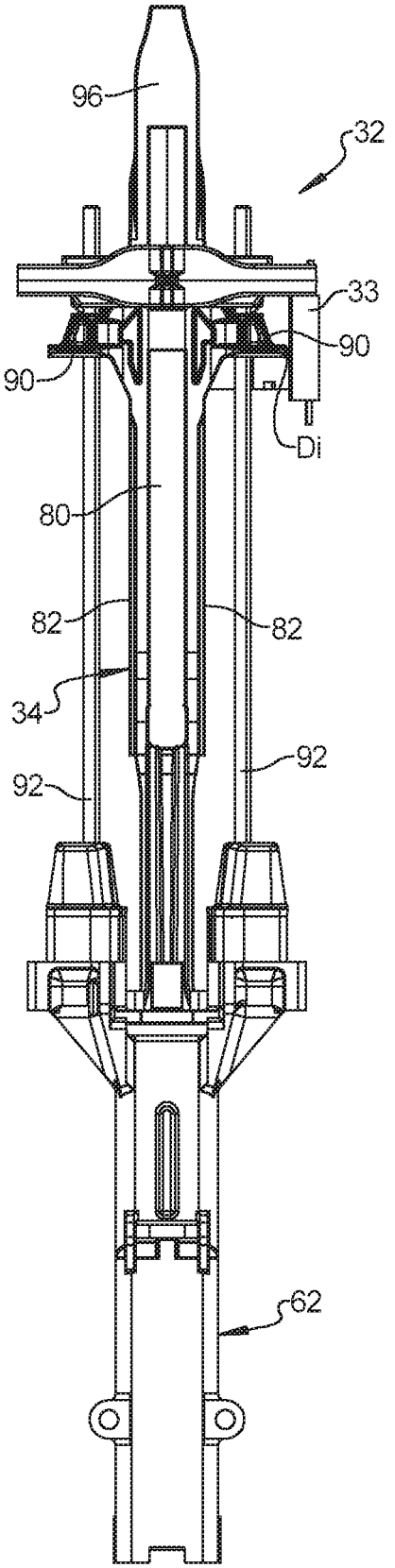
FIG. 6 is a major side elevation view including various components of the example electric fastener driving tool assembly of FIG. 1 with the driver in the home position.
Figure 7:
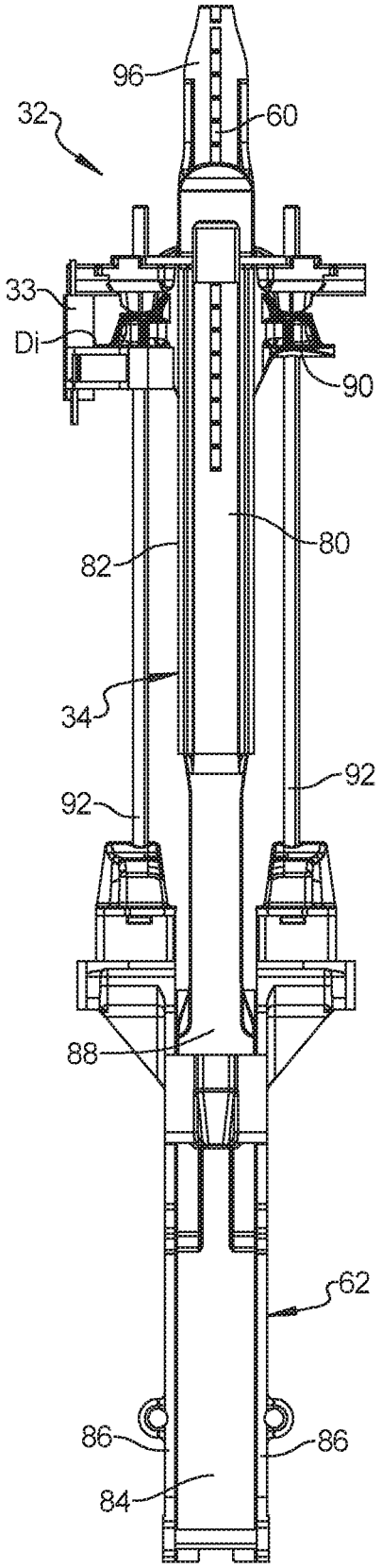
FIG. 7 is an opposite major side elevation of the components of FIG. 6.

Example embodiments will now be described more fully with reference to the accompanying drawings.

FIGS. 1-9 illustrate an exemplary cordless electric fastener driving tool 30 including a first example of an assembly 32 including a home position sensor 33 in accordance with the present disclosure. The tool 30 and electric fastener driving assembly 32 can include a driver 34, a drive motor assembly 36 including a rotatable flywheel 38, a driver return mechanism or assembly 40, a power take-off unit 42, a controller or control unit 44, a nosepiece assembly 46, a magazine assembly 48 and a rechargeable battery pack 50.

Figure 8:
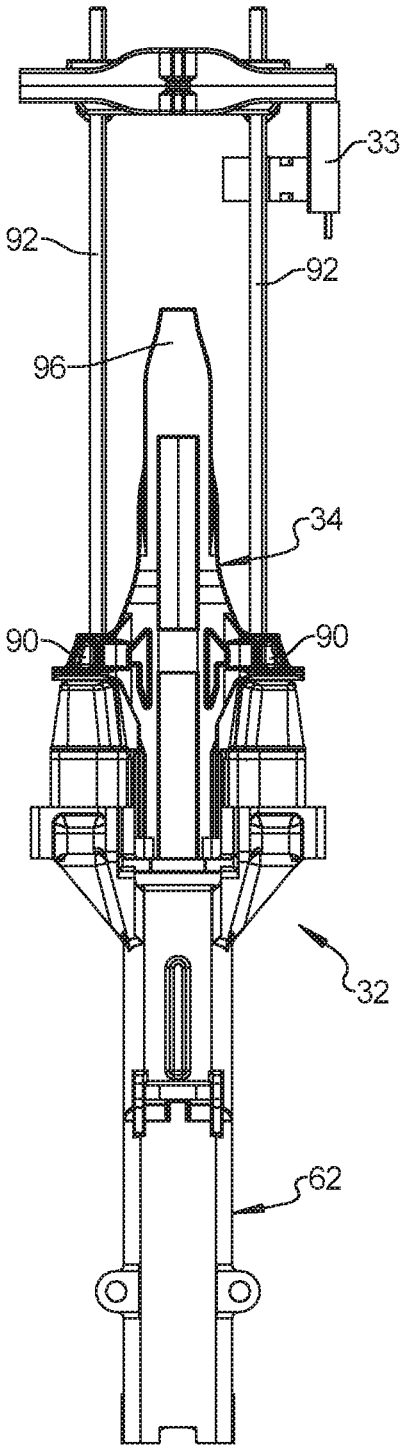
FIG. 8 is a major side elevation view including various components of the example electric fastener driving tool assembly of FIG. 1 with the driver in the extended position.
Figure 9:
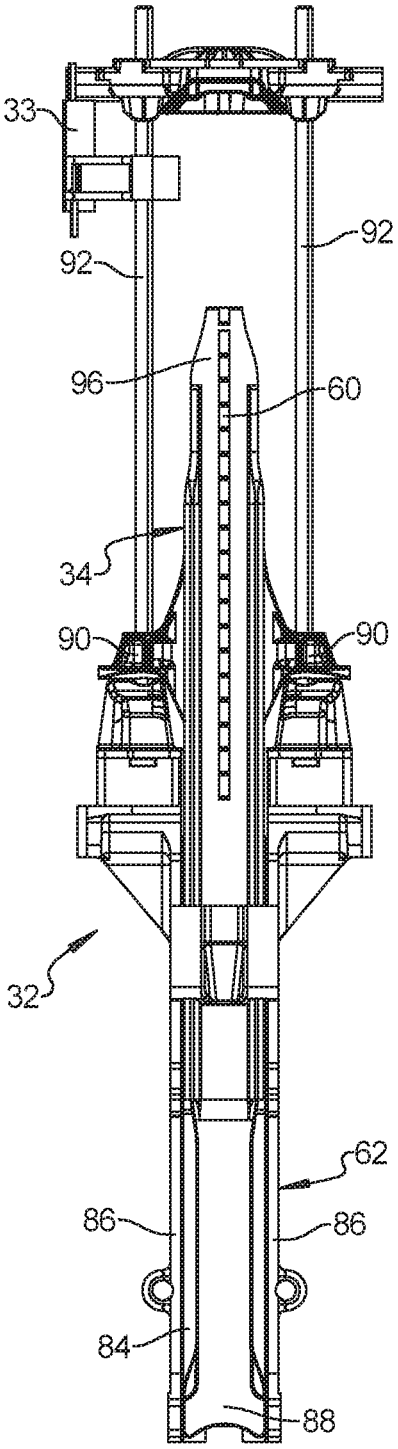
FIG. 9 is an opposite major side elevation of the components of FIG. 8.

The power take-off unit 42 can include a drive solenoid 52 that actuates to cause a pinch roller 54 to pinch the driver 34 against the flywheel 38 and drive the driver 34 from its home position (FIGS. 6 and 7) to its extended position (FIGS. 8 and 9). The driver return mechanism or assembly 40 can include a return solenoid 56 that actuates causing a return pawl 58 to swing or pivot outwardly to engage ratchet teeth 60 of the driver 34 and move the driver 34 toward the home opposition. Several rapid successive actuations or reciprocations of the return solenoid 56 can operate to return the driver 34 to its home position.

The driver 34 can be designed to drive a fastener, such as a nail or a staple into a workpiece. The driver 34 can have a generally rectangular cross-section with a major dimension aligned with opposite major sides 80, and with a minor dimension aligned with opposite minor sides 82 of the driver 34. The driver 34 can reciprocate along an axial driver path from its home position (FIGS. 6 and 7) into a non-home position (FIGS. 4, 5, 8 and 9) and toward its extended position (FIGS. 8 and 9) to drive the fastener and then return back to its home position.

The nosepiece assembly 46 can include a nosepiece or nosepiece component 62 and a contact trip 64. The driver 34 can be guided along its axial driver path by the nosepiece assembly 46. For example, the nosepiece or nosepiece component 62 can have a generally U-shaped cross-section formed by a base wall 84 extending between two generally parallel side walls 86. Thus, the side walls 86 can be engageable with the opposite minor sides 82 of the driver 34, and the base wall 84 can be engageable with one of the major sides 80 of the driver 34 to help guide a leading end 88 of the driver 34 along its axial driver path.

The driver 34 can also include a pair of guide ears 90 that can extend laterally in a direction aligned with the major dimension. Axially aligned guide rails 92 can extend through apertures 94 in the guide ears 90 to help guide a trailing end 96 of the driver 34 along its axial driver path. The home position sensor 34 can be positioned laterally adjacent one of the guide ears 90 in a direction aligned with the major direction when the driver 34 is in its home position. When the driver 34 is in a non-home position such as the intermediate position of FIGS. 4 and 5, the lateral distance Do between the driver 30 and the home position sensor 33 is relatively large. When the driver 34 is in the home position of FIGS. 6 and 7, the lateral distance Di between the driver 34 and the home position sensor 33 is relatively small. The home position sensor 33 can be located to sense the presence of the driver 34 in the home position when the lateral distance between the driver 34 and the home position sensor 33 decreases. In other words, the home position sensor 33 can be located so that the sensor 33 does not sense the presence of the driver 34 at the larger lateral distance Do, but does sense the presence of the driver 34 at the smaller lateral distance Di.

When the guide ear 90 closest to the home position sensor 33 moves axially into a position laterally adjacent the home position sensor 33, this causes the lateral distance between the driver 34 and the sensor 33 to decrease sufficiently that the sensor 33 is able to sense the presence of the driver 34. Because the axial location of the home position sensor 33 is such that this occurs when the driver 34 is in the home position, the home position sensor 33 can provide a driver home position presence signal. Thus, this closest guide ear 90 comprises a target portion of the driver 90 that comes closer to the home position sensor 33 to decrease the lateral distance between the driver 34 and the sensor 33.

As in this example, the home position sensor 33 can be an induction sensor. The induction sensor can be electrically coupled to the controller 44 to send the driver home position presence signal thereto. The controller 44 can include an electrical circuit 66. For example, the circuit 66 can include a discrete timing chip 68, a series of logic gates 70, a counter 72, and input/output terminals 74. As another example, the circuit 66 can analogously include a CPU 70, memory 72, a clock 68, and an input/output 74. The circuit 66 can include, or can be operably coupled to, various switches and components, such as a trigger switch 76 and a contact trip switch 78, and to various other components, such as the return solenoid 56, the drive solenoid 52, and the home position sensor 33.

In the CPU example, the CPU 70 can be programmed to energize and de-energize the drive solenoid 52 and the return solenoid 56. One example of such CPU programming can include: (1) Confirming that the non-fire/fire status register in memory is set to the "fire" status and, (1a) if set to "fire," sending a signal to energize the drive solenoid and simultaneously setting the non-fire fire status register to the "non-fire" status; (1b) if set to non-fire, returning to (1); then after (1a), (2) sending a signal to energize the return solenoid 70 at a predetermined initiation period of time after the CPU initiates firing or driving of the driver 34; then (3) at a predetermined period of energized time after the CPU sends the signal to energize the return solenoid 56, the CPU sends a signal to de-energize the solenoid 56; next, (4) the CPU increments a cycle register by 1 and compares that to a predetermined number of cycles; and (5a) if the number in the cycle register is less than a predetermined number of cycles, then at a predetermined period of de-energized time after the CPU sends the signal to energize the solenoid, the CPU send a signal to again energize the return solenoid 56 and return to step (2); or (5b) if the number in the cycle register is equal to the predetermined number of cycles, then the CPU resets the cycle register to zero and stops this solenoid energization/de-energization loop; or (5c) if the CPU has received a driver home position presence signal from the home position sensor 33, then the CPU resets the cycle register to zero and stops this solenoid energization/de-energization loop; and (6) upon receipt of the home position signal changing the "non-fire" status of the non-fire/fire register to the "fire" status.

Additional details regarding an example tool, including details related to various components identified herein, are provided in commonly-owned U.S. patent application Ser. No. 15/630,044, filed on Jun. 22, 2017, published as U.S. Patent Application Publication No. 2018/0001455 on Jan. 4, 2018, and U.S. patent application Ser. No. 15/630,273, filed on Jun. 22, 2017, published as U.S. Patent Application Publication No. 2018/0001456 on Jan. 4, 2018, each of which is hereby incorporated herein by reference in its entirety.

FIGS. 10-16 illustrate a second exemplary cordless electric fastener driving tool assembly 32 including a home position sensor 33 in accordance with the present disclosure. For the sake of brevity, common aspects between the various embodiments are generally not duplicated herein. As in this embodiment, the home position sensor 33 can be coupled to an outer side of the base wall 84 of the nosepiece component 62. An opening 98 can be provided through the base wall 84 adjacent the home position sensor 33 to reduce intervening material between the sensor 33 and the driver 34 moving along the drive path between the side walls 86 of the nosepiece component 62. The base wall 84 can include a non-laterally raised surface 100 and a laterally recessed surface 100. Thus, the driver 34 is spaced from the home position sensor 33 in a lateral distance that extends in a direction between a major side of the driver 34 and the home position sensor 33. The direction can be essentially normal to the major direction of the driver 34.

Figure 10:
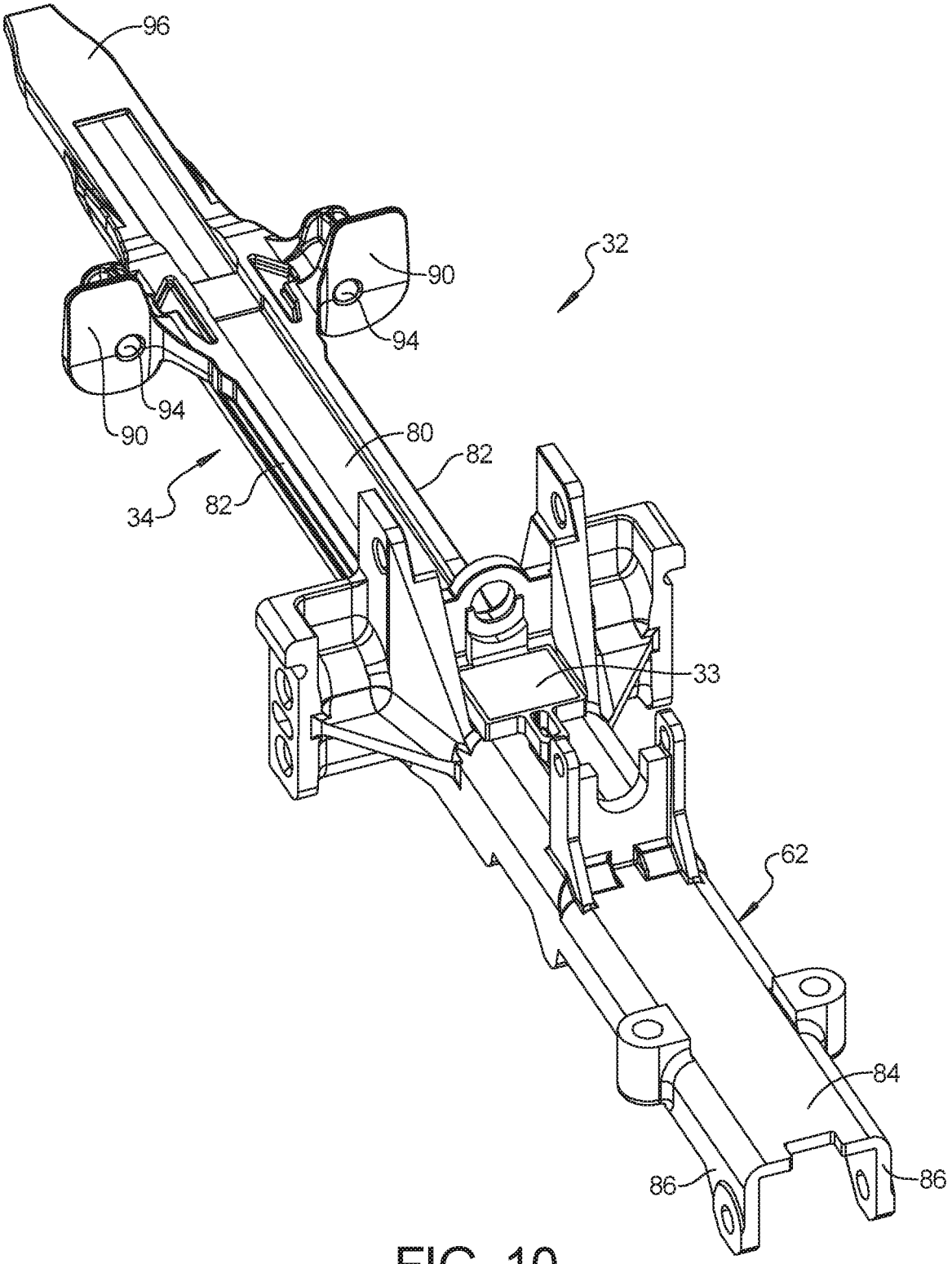
FIG. 10 is a perspective view of various components of a second example of an electric fastener tool assembly including a home position sensor in accordance with the present disclosure.
Figure 11:
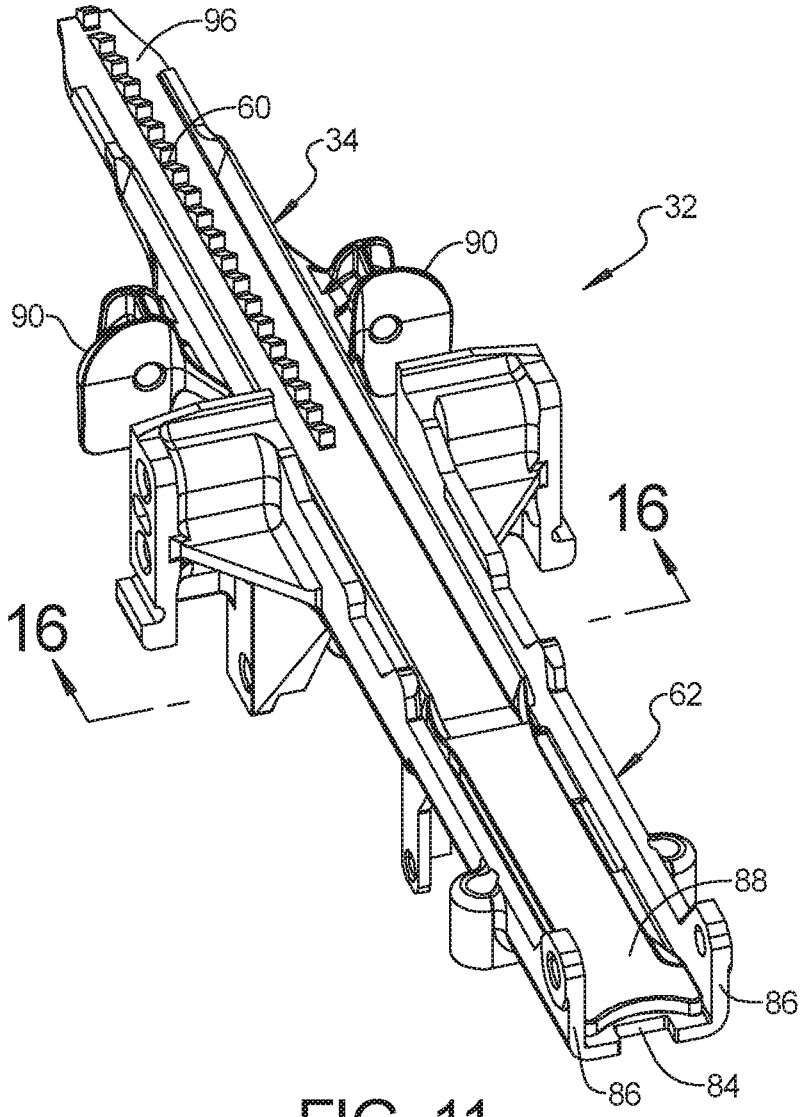
FIG. 11 is a perspective view of the components of the second example assembly of FIG. 10 with the driver in a non-home position.
Figure 16:
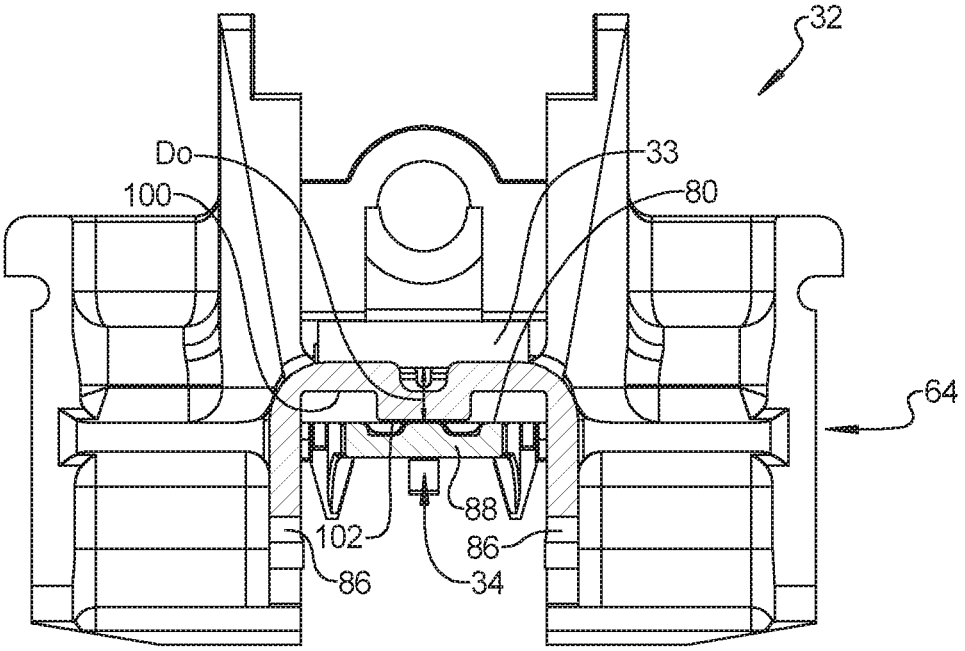
FIG. 16 is a partial cross-section view taken along line 16-16 of FIG. 12 with the driver in a home position.
Figure 17:
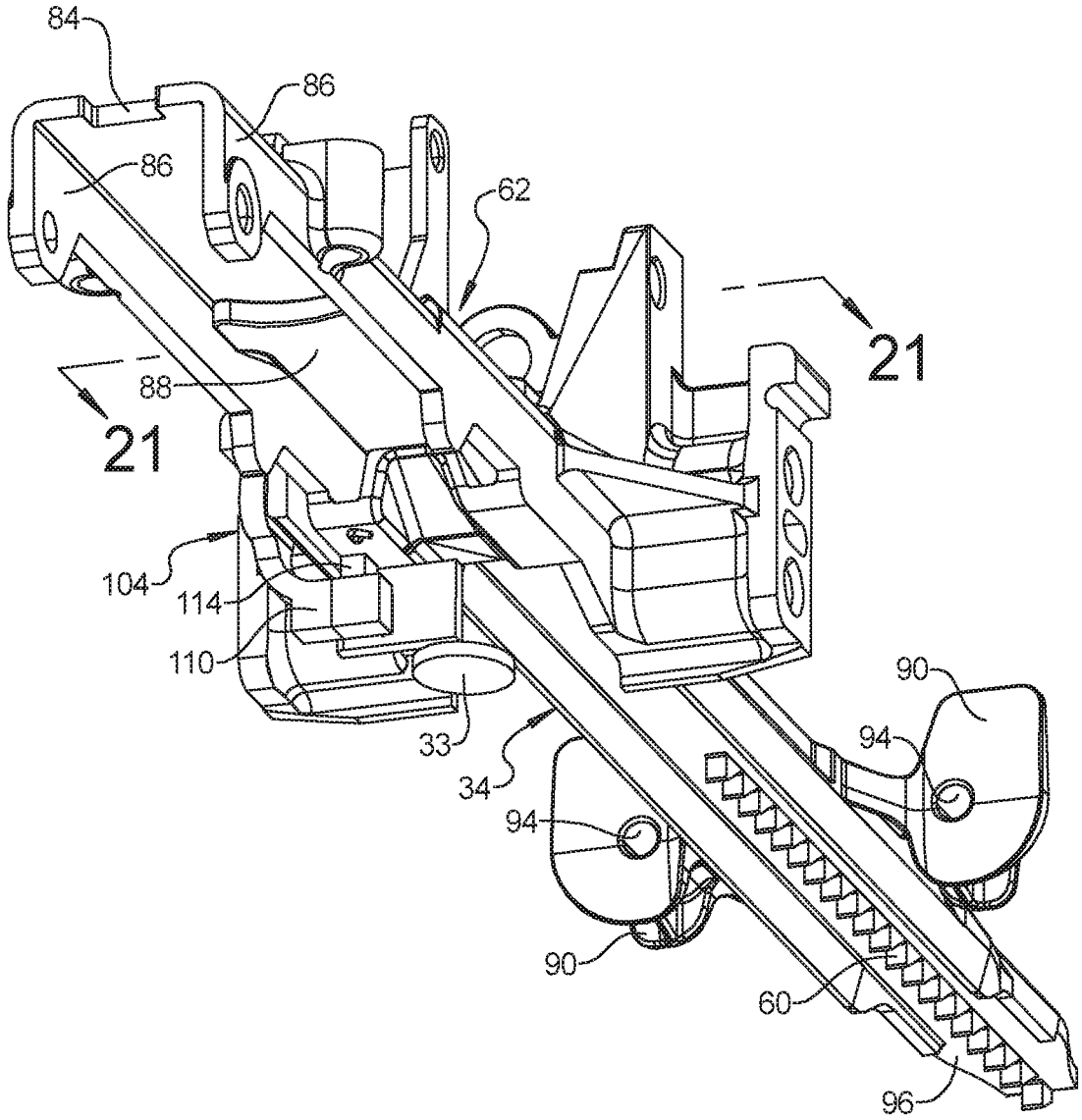
FIG. 17 is a perspective view of various components of a third example of an electric fastener tool assembly including a home position sensor in accordance with the present disclosure with the driver in a non-home position.
Figure 18:
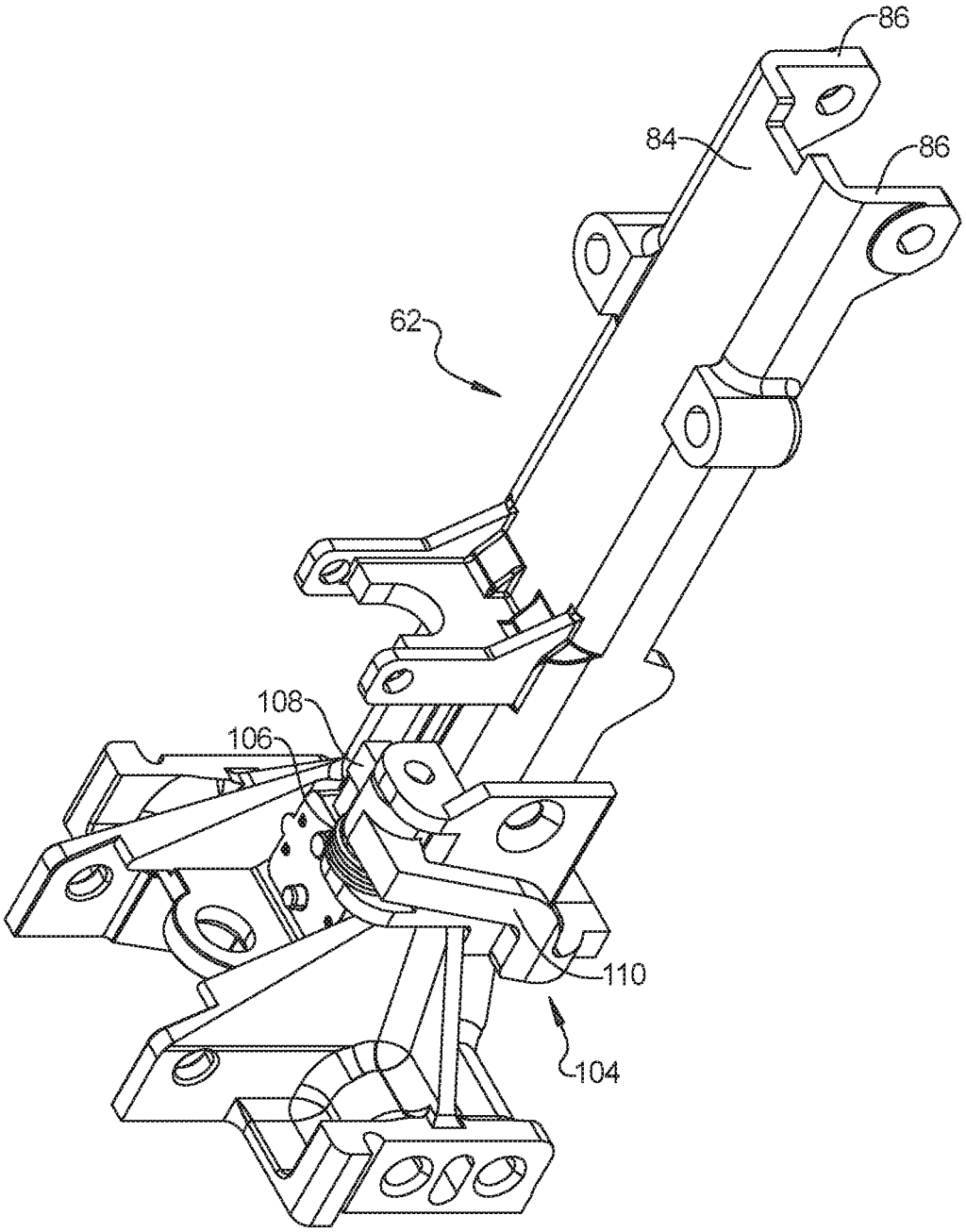
FIG. 18 is a perspective view of various components of the third example assembly of FIG. 17.
Figure 19:
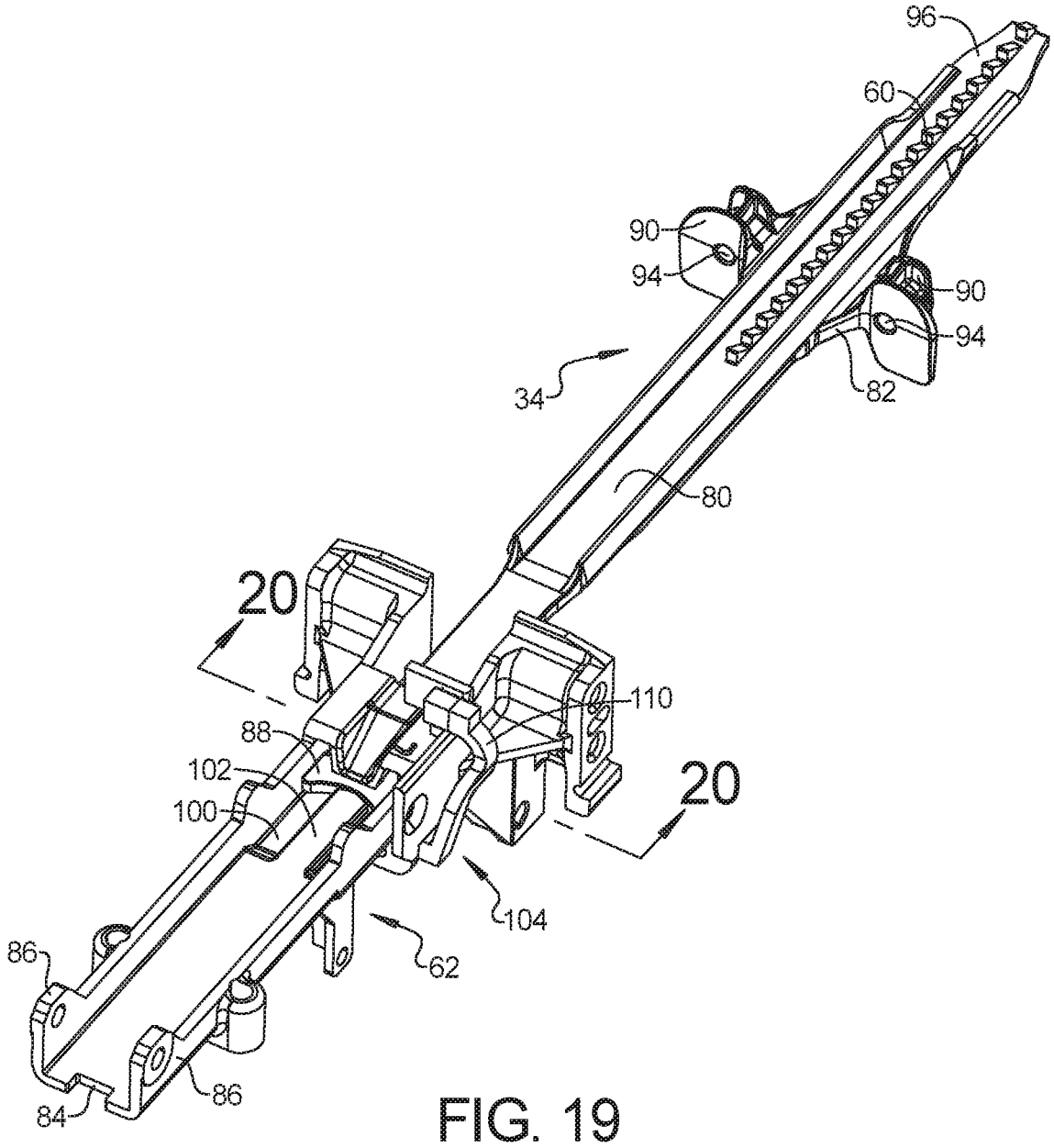
FIG. 19 is another perspective view of the third example assembly of FIG. 17 with the driver in a home position.
Figure 20:
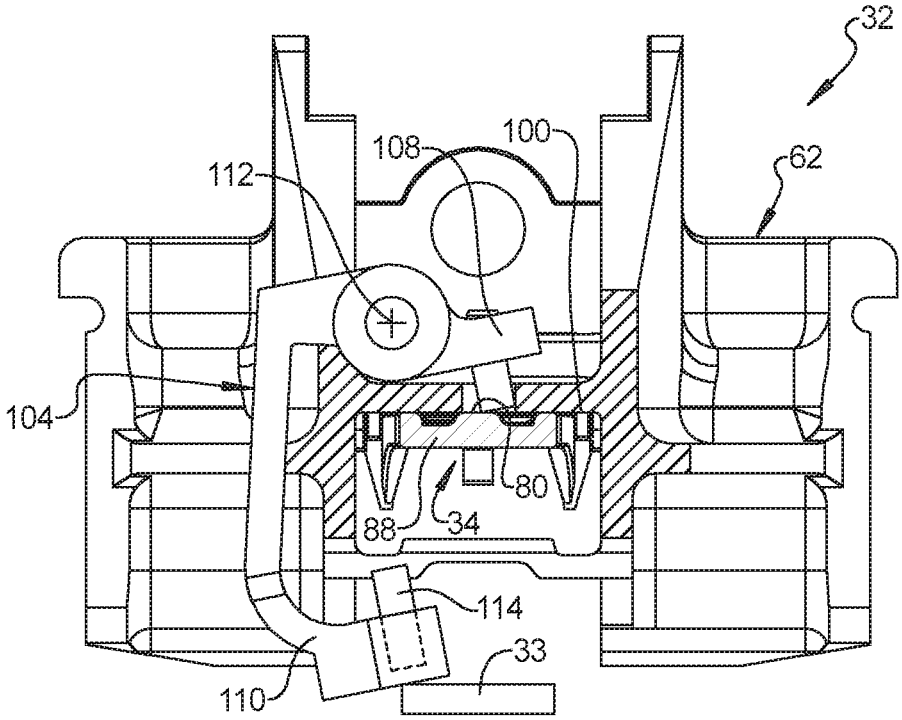
FIG. 20 is a partial cross-section view taken along line 20-20 of FIG. 17 with the driver in a non-home position.
Figure 21:
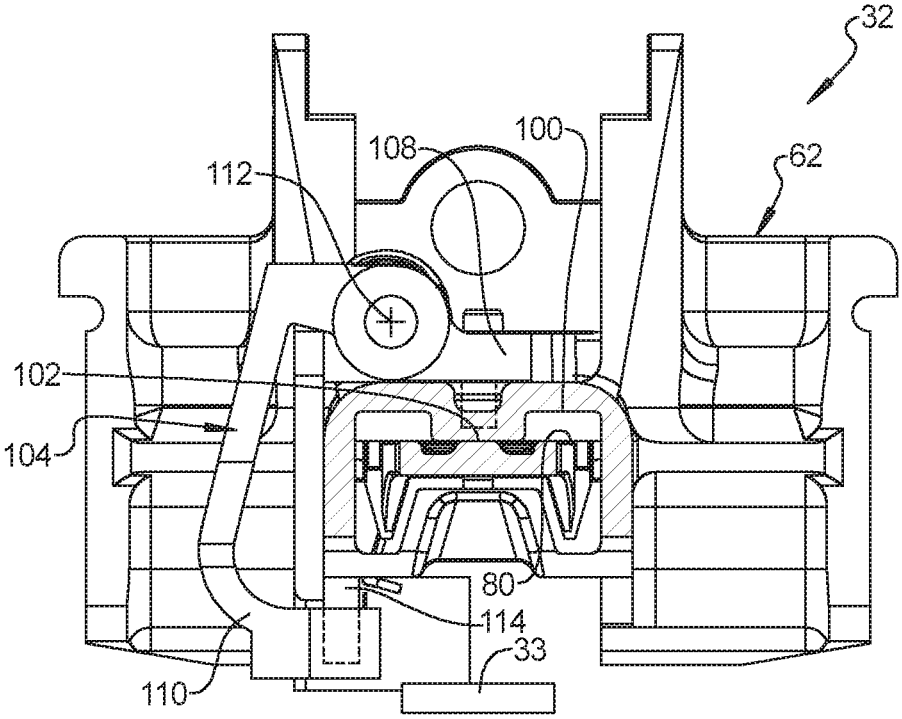
FIG. 21 is a partial cross-section view taken along line 21-21 of FIG. 19 with the driver in a home position.
Figure 22:
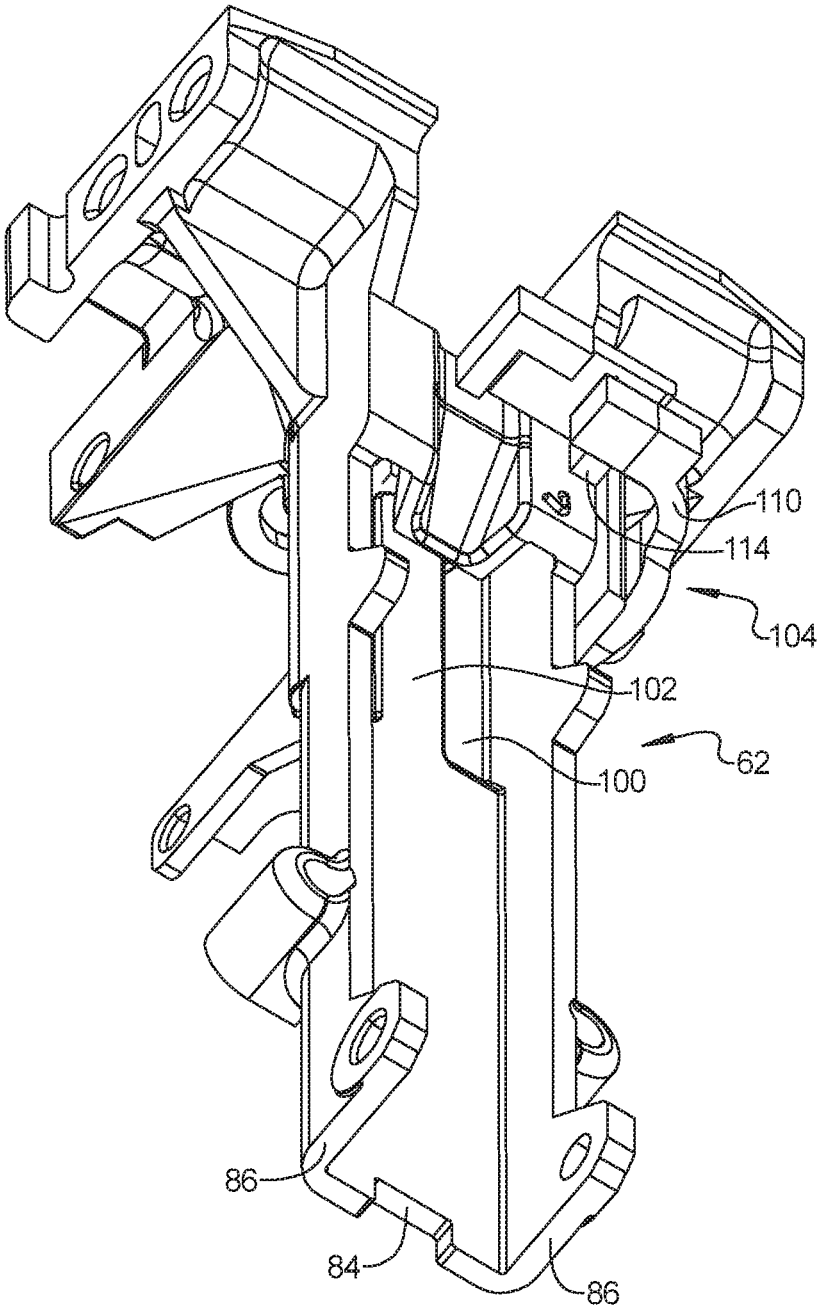
FIG. 22 is a perspective view of the nosepiece component of FIG. 18.

Referring to FIGS. 10, 11, and 16, when the driver 34 is pinched against the flywheel 38 and the driver 34 is out of the home position, the driver 34 is adjacent the non-laterally recessed surface 102 of the base wall 84. Thus, when the driver 34 is out of the home position, the driver 34 is spaced from the home position sensor 33 a lateral distance Do that is greater than when the driver is in the home position. This lateral distance Do can include the difference in lateral height between the non-laterally recessed surface 102 and the laterally recessed surface 100.

Figure 12:
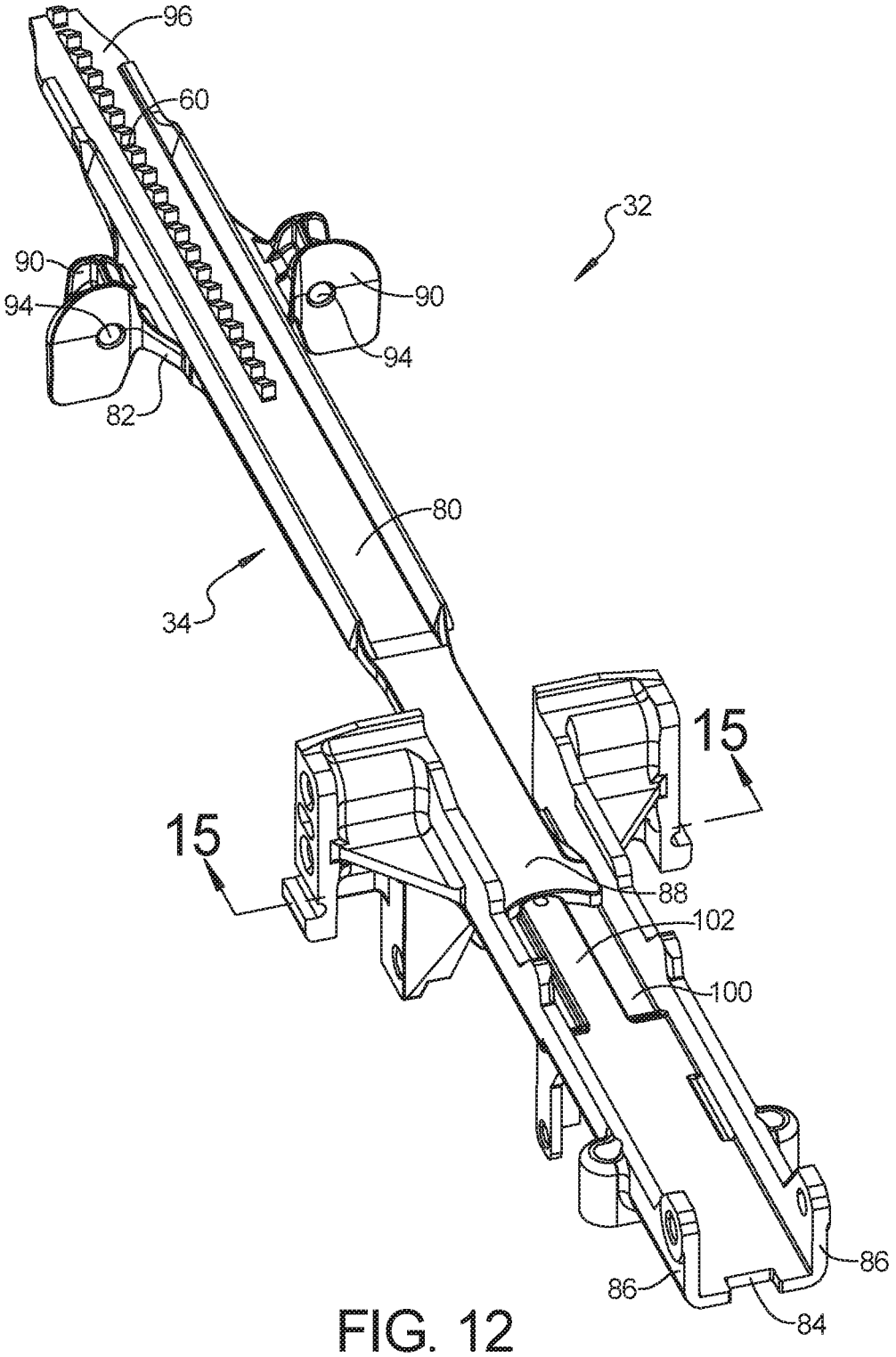
FIG. 12 is a perspective view similar to FIG. 11, but with the driver in a home position.
Figure 13:
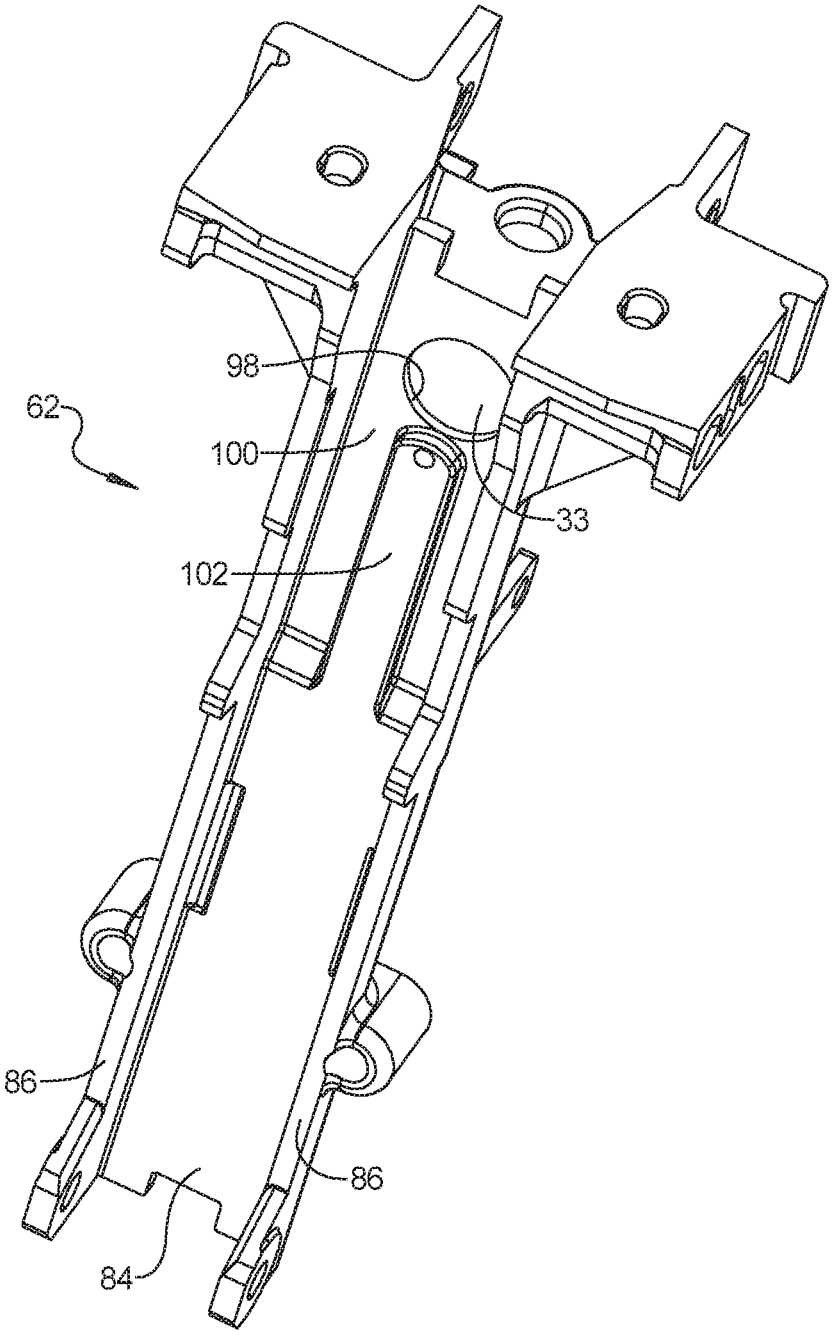
FIG. 13 is a perspective view of the nosepiece component of FIG. 10.
Figure 14:
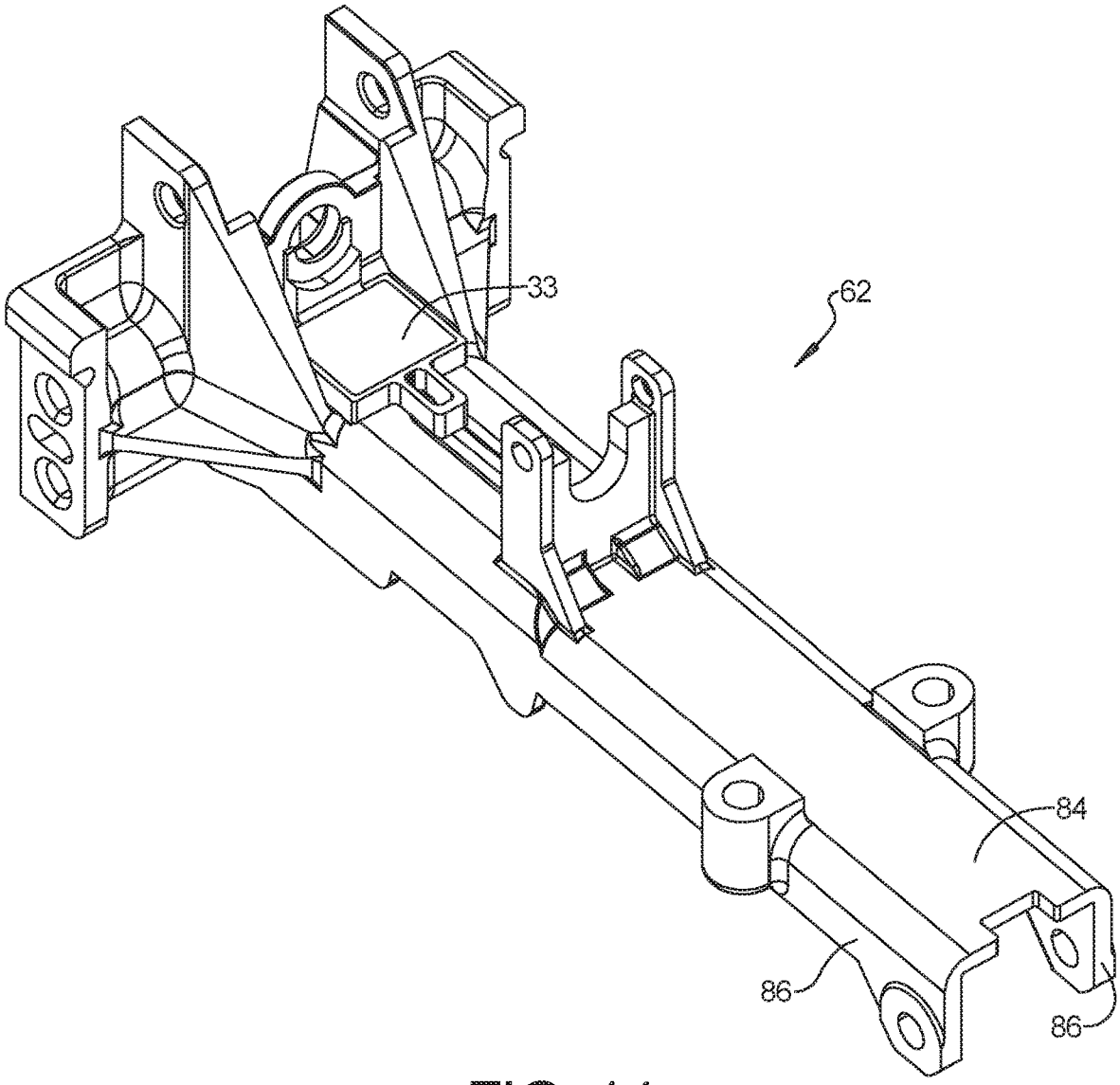
FIG. 14 is another perspective view of the nosepiece component of FIG. 10.
Figure 15:
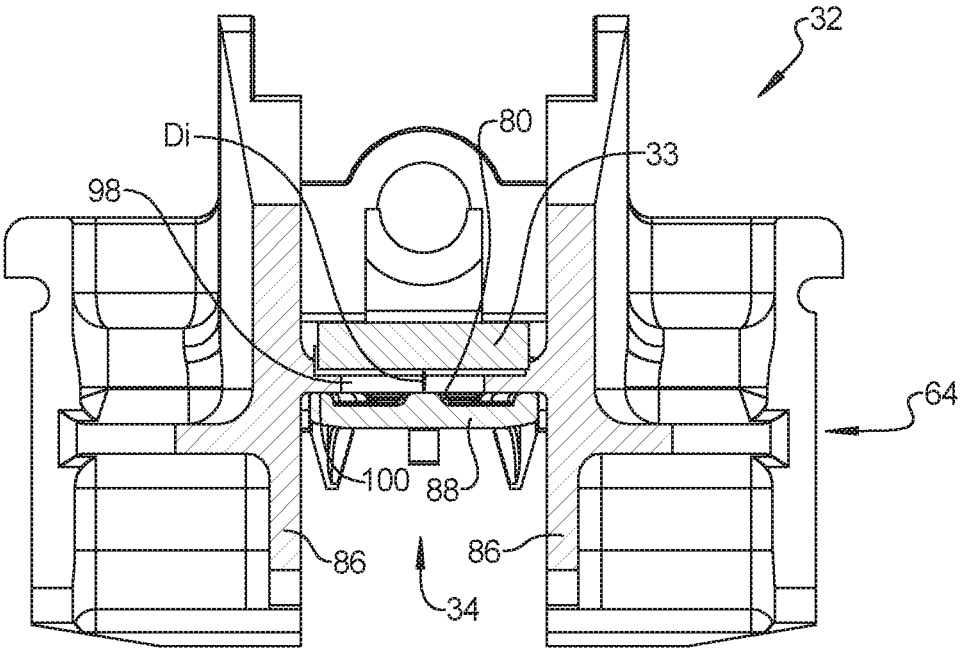
FIG. 15 is a partial cross-section view taken along line 15-15 of FIG. 11 with the driver in a non-home position.

Referring to FIGS. 12 and 15, when the driver is in the home position, the driver 34 is not pinched against the flywheel 38 and a leading end 88 of the driver 34 is positioned against the laterally recessed surface 100. Thus, when the driver 34 is in the home position, the driver 34 is spaced from the home position sensor 33 a lateral distance Di that is less than Do. This distance Di can essentially be a thickness of the base wall 84, or less as a result of a recess therein. In addition, the opening 98 can provide an unobstructed path in the laterally extending direction between the leading end 88 of the driver 34 and the home position sensor 33.

The home position sensor 33 can be an induction sensor. The home position sensor 33 can be positioned at lateral distance from the adjacent major side of the driver 34 so that the sensor 33 does not detect the presence of the driver 34 at the lateral distance Do maintained by the non-laterally recessed surface 102, but where the home position sensor 33 can detect the presence of the driver 34 at the lesser lateral distance Di when the leading end 88 of the driver 34 is in its home position against the laterally recessed surface 100. Thus, the leading end 88 of the driver 34 can be a target portion of the driver 34 that comes laterally closer to the home position sensor 33 to cause the lateral distance between the driver 34 and the sensor 33 to change by decreasing.

FIGS. 17-22 illustrate a third exemplary cordless electric fastener driving tool assembly 32 including a home position sensor 33 in accordance with the present disclosure. As in prior embodiment, this embodiment can rely upon the same lateral movement of the driver 34 resulting from the driver 34 being laterally engageable against the non-recessed surface 102 when the driver 34 is in its non-home position (FIGS. 17 and 21) and being laterally engageable against the recessed surface 100 when the driver 34 is in its home position.

In this embodiment, the home position sensor 33 can be located adjacent an opposite major side 80 of the driver 34, such that the lateral distance between the driver 34 and the sensor 34 changes by increasing when the leading end 88 of the driver 34 moves from the non-home position into the home position against the laterally recessed surface 100. A pivot arm 104 can be provided that can be biased toward a rest position (FIG. 21), for example by a spring 106. The pivot arm 104 can pivot about an axis with a driver end 108 extending on one side of the pivot axis and a sensor end 110 extending on an opposite side of the pivot axis 112.

When the driver 34 is in a non-home position, the driver 34 is maintained laterally away from a first driver end 108 of the pivot arm 104 by the non-recessed surface 102. Thus, the pivot arm 104 can remain in its rest position. When the driver 34 moves into the home position (FIG. 20), the leading end 88 of the driver 34 can engage against the laterally recessed surface 100. This can allow the driver 34 to contact the driver end 108 of the pivot arm 104 and cause the pivot arm 104 to pivot out of the rest position and toward a sensed position. In the sensed position, the sensor end 110 of the pivot arm 104 is moved closer to the home position sensor 33.

The configuration of the pivot arm 104, including the position of the pivot axis 112 and the relative lengths of the driver end 108 and sensor end 100, can result in movement of a sensor target 114 carried by the sensor end that is much greater than the lateral movement of the driver 34 between its non-home and home positions. The sensor target 114 can be a magnet and the home position sensor 33 can be a hall effect sensor.

Although the terms first, second, third, may be used herein, these terms are only used to distinguish similarly named elements from each other and do not imply a sequence or order of importance.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electric fastener driving tool assembly comprising:

a driver designed to drive a fastener into a workpiece, the driver reciprocating along an axial driver path between an extended position and a home position;

a home position sensor located laterally adjacent the axial driver path, the home position sensor being located to sense the presence of the driver in the home position when a lateral distance between the driver and the home position sensor changes.

2. The electric fastener driving tool assembly of claim 1, wherein the lateral distance between the driver and the home position sensor changes as a result of a target portion of the driver coming closer to the home position sensor to change the lateral distance by decreasing the lateral distance.

3. The electric fastener driving tool assembly of claim 1, wherein a laterally extending driver guide ear comprises a target portion of the driver that comes closer to the home position sensor to cause the lateral distance between the driver and the home position sensor to change.

4. The electric fastener driving tool assembly of claim 1, wherein a leading end of the driver comprises a target portion of the driver that comes closer to the home position sensor to cause the lateral distance between the driver and the home position sensor to change.

5. The electric fastener driving tool assembly of claim 1, wherein the driver has opposite major sides with opposite minor sides therebetween, and the lateral distance extends between one of the opposite minor sides and the home position sensor located adjacent the one of the opposite minor sides.

6. The electric fastener driving tool assembly of claim 1, wherein the driver has opposite major sides with opposite minor sides therebetween, and the lateral distance extends between a first of the opposite major sides and the home position sensor located adjacent the first of the opposite major sides.

7. The electric fastener driving tool assembly of claim 1, wherein the lateral distance between the driver and the home position sensor changes as a result of a leading end of the driver moving farther away from the home position sensor to change the lateral distance by increasing the lateral distance.

8. The electric fastener driving tool assembly of claim 1, wherein a pivot arm is biased toward a rest position and, when the lateral distance between the driver and the home position sensor changes, the driver engages the pivot arm to move the pivot arm from the rest position to a sensed position in which a portion of the pivot arm is closer to the home position sensor than in the rest position.

9. The electric fastener driving tool assembly of claim 1, wherein the lateral distance between the driver and the home position sensor changes by increasing.

10. The electric fastener driving tool assembly of claim 1, wherein the home position sensor is a hall effect sensor.

11. The electric fastener driving tool assembly of claim 1, wherein the home position sensor is an induction sensor.

12. The electric fastener driving tool assembly of claim 1, wherein the axial driver path extends at least partially along a nosepiece component having a base wall with a first major side of the driver engageable against a laterally recessed surface of the base wall in the home position and engageable against a non-laterally recessed surface of the base wall when the driver is out of the home position, and wherein the lateral distance between the driver that the home position sensor changes comprises the lateral distance between the non-recessed and raised surfaces of the base wall of the nosepiece component.

13. The electric fastener driving tool assembly of claim 1, wherein the home position sensor is electrically coupled to a controller including a microprocessor circuit and memory and the controller is electrically coupled to a reciprocating driver return solenoid, and wherein the controller is configured to interrupt operation of the driver return solenoid upon receipt of a driver presence signal from the home position sensor.

14. The electric fastener driving tool assembly of claim 1, wherein the home position sensor is electrically coupled to a controller including a microprocessor circuit and memory and the controller is electrically coupled to a reciprocating driver drive solenoid, a trigger switch and a contact trip switch, and wherein the controller is configured to prevent activation of the drive solenoid unless each of the trigger switch and the contact trip switch are in a fire position and the home position sensor indicates the driver has returned to the home position.

15. A cordless electric fastener driving tool assembly comprising:

a driver designed to drive a fastener into a workpiece, the driver reciprocating along an axial driver path between an extended position and a home position, and the driver including a laterally extending driver guide ear comprising a target portion of the driver;

a home position sensor located laterally adjacent the axial driver path, the home position sensor being located to sense the presence of the driver in the home position when the target portion of the driver guide ear comes closer to the home position sensor as the driver guide ear moves into a position laterally adjacent to the home position sensor to cause the lateral distance between the driver and the home position sensor to decrease.

16. The cordless electric fastener driving tool assembly of claim 15, wherein the home position sensor is an induction sensor.

17. The cordless electric fastener driving tool assembly of claim 15, wherein the home position sensor is electrically coupled to a controller including a microprocessor circuit and memory and the controller is electrically coupled to a reciprocating driver return solenoid, and wherein the controller is configured to interrupt operation of the driver return solenoid upon receipt of a driver presence signal from the home position sensor.

18. The electric fastener driving tool assembly of claim 15, wherein the home position sensor is electrically coupled to a controller including a microprocessor circuit and memory and the controller is electrically coupled to a reciprocating driver drive solenoid, a trigger switch and a contact trip switch, and wherein the controller is configured to prevent activation of the drive solenoid unless each of the trigger switch and the contact trip switch are in a fire position and the home position sensor indicates the driver has returned to the home position.

19. The cordless electric fastener driving tool assembly of claim 15, wherein the home position sensor is an induction sensor, and the home position sensor is electrically coupled to a controller including a microprocessor circuit and memory and the controller is electrically coupled to a reciprocating driver return solenoid, and wherein the controller is configured to interrupt operation of the driver return solenoid upon receipt of a driver presence signal from the home position sensor.

20. The cordless electric fastener driving tool assembly of claim 15, wherein the home position sensor is an induction sensor, and the home position sensor is electrically coupled to a controller including a microprocessor circuit and memory and the controller is electrically coupled to a reciprocating driver drive solenoid, a trigger switch and a contact trip switch, and wherein the controller is configured to prevent activation of the drive solenoid unless each of the trigger switch and the contact trip switch are in a fire position and the home position sensor indicates the driver has returned to the home position.

* * * * *